US007572209B2

(12) United States Patent
Brennan

(10) Patent No.: US 7,572,209 B2
(45) Date of Patent: Aug. 11, 2009

(54) GIANT TRAINER

(76) Inventor: James C. Brennan, 82 Hollow Branch Crossing, Ormond Beach, FL (US) 32174

( * ) Notice: Subject to any disclaimer, the term of this patent is extended or adjusted under 35 U.S.C. 154(b) by 0 days.

(21) Appl. No.: 11/742,968

(22) Filed: May 1, 2007

(65) Prior Publication Data

US 2008/0274859 A1 Nov. 6, 2008

(51) Int. Cl.
*A63B 1/00* (2006.01)

(52) U.S. Cl. ..... 482/43; 482/38

(58) Field of Classification Search ..... 482/23, 482/24, 43, 143, 38; 472/118–124
See application file for complete search history.

(56) References Cited

U.S. PATENT DOCUMENTS 1,927,025 A * 9/1933 Dahl ..... 472/121
2,123,233 A * 7/1938 Crawford ..... 482/24
3,171,653 A * 3/1965 Pacuk ..... 472/120
3,359,976 A * 12/1967 Laval, Jr. ..... 602/36
3,716,231 A * 2/1973 Martin ..... 482/144
4,382,595 A * 5/1983 Tolar ..... 472/118
4,714,247 A 12/1987 Gerstung
5,839,965 A * 11/1998 Mullins ..... 472/118
6,702,686 B1 * 3/2004 Brown ..... 472/118
6,932,710 B1 * 8/2005 Hartin ..... 472/118
7,097,590 B2 8/2006 Canali et al.
7,175,535 B1 * 2/2007 Marmentini ..... 472/118

* cited by examiner

*Primary Examiner*—Loan H Thanh
*Assistant Examiner*—Allana Lewin
(74) *Attorney, Agent, or Firm*—Darby & Darby P.C.

(57) ABSTRACT

A trainer for tap swing and giant swing training (collectively, "giant maneuvers") on a high bar comprises an engagement rotatably coupled to the high bar, a cantilever affixed to the engagement, an upper support member joined at an obtuse angle to the cantilever, a lower support member pivotally coupled to the upper support member, a foot grasp joined to the lower support member at a location remote from the pivotal coupling to the upper support member, and a safety harness coupled to at least one of the upper support member and the lower support member proximate to the pivotal coupling.

7 Claims, 2 Drawing Sheets

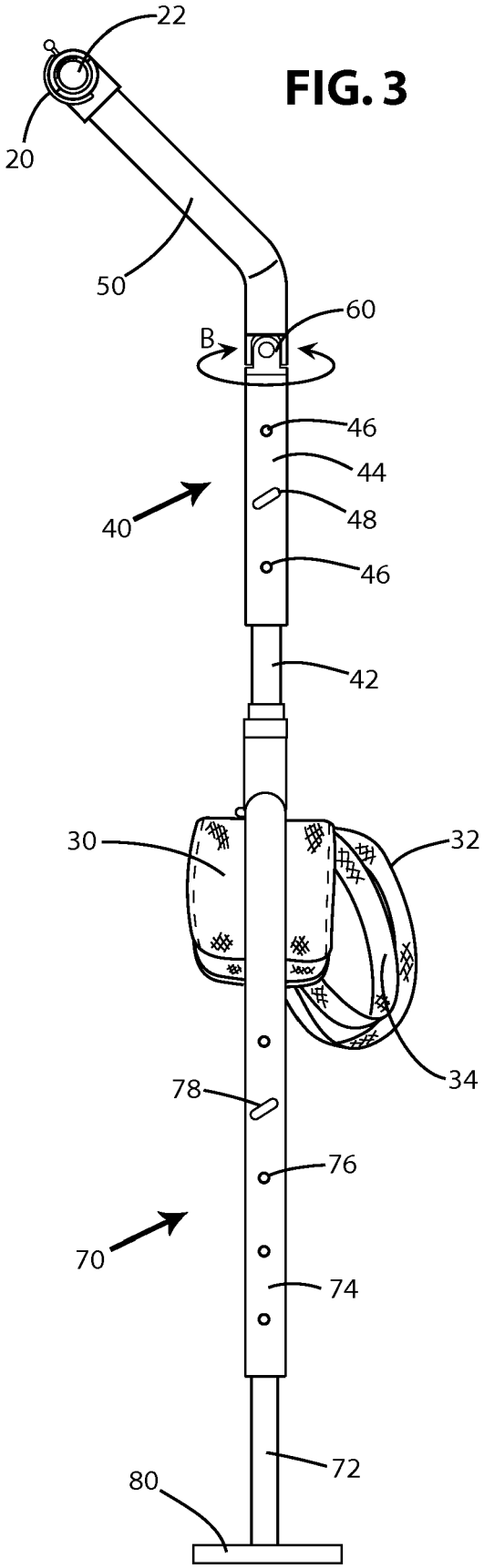
FIG. 3
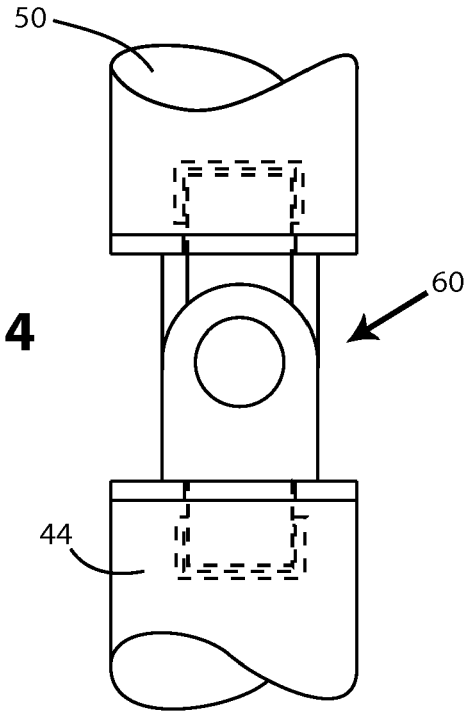
FIG. 4
FIG. 5
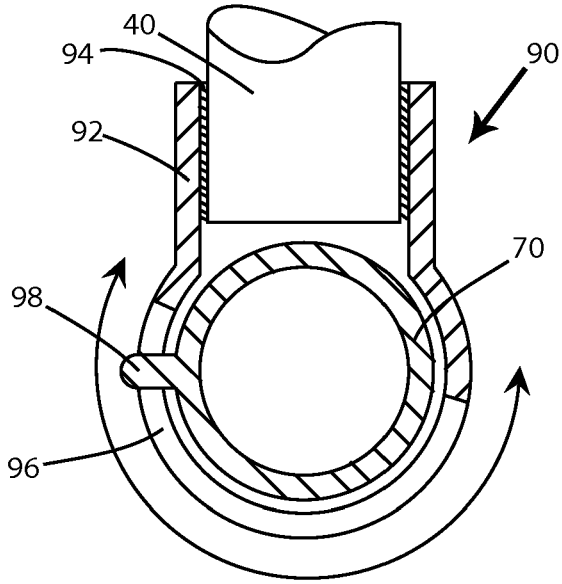

GIANT TRAINER

FIELD OF THE INVENTION

The present invention relates to equipment for use in a gymnasium, and more particularly to equipment suitable for tap swing and giant swing training, a movement in which a gymnast revolves around the high bar, and methods for using such equipment.

BACKGROUND OF THE INVENTION

To assist in training to perform giant swings, straps have been arranged relative to the high bar. The gymnast wraps his or her hands about the straps and supported from the bar by a PVC collar and holds them as casts, push aways and swings are performed to practice the giant maneuver. However, the gymnast does not properly grip the high bar itself when using straps for training, and, therefore, does not practice of all motions used in performing a giant maneuver. In particular, in the course of performing a giant, trainees can get "stuck" or fall once past perpendicular because they do not learn to shift their grip when using conventional trainers. Strength, form and timing of movement are critical to giant completion, particularly wrist shifting motions.

While safety of the user is promoted by using straps as in prior designs, an improved giant trainer is needed in the art, such as one that addresses wrist motions as well as abdominal muscles, shoulder muscles, back muscles, and which enhances safety by not allowing the gymnast to come off the bar or collapse into the bar past perpendicular.

SUMMARY OF THE INVENTION

In accordance with one aspect of the invention, a trainer for tap swing and giant swing training (collectively, "giant maneuvers") on a high bar comprises an engagement rotatably coupled to the high bar, a cantilever affixed to the engagement, an upper support member joined at an obtuse angle to the cantilever, a lower support member pivotally coupled to the upper support member, a foot grasp joined to the lower support member at a location remote from the pivotal coupling to the upper support member, and a safety harness coupled to at least one of the upper support member and the lower support member proximate to the pivotal coupling.

In further aspects, the trainer can include a moveable joint which couples the cantilever to the engagement, and a resistance element can be disposed between the high bar and the engagement such as may be used to impart fixed or varying resistance against rotation of the engagement relative to the high bar.

Further characteristics and advantages of the invention will become better apparent from the description of a preferred but not exclusive embodiment of the piece of gym equipment according to the present invention, illustrated by way of non-limiting example in the accompanying drawings.

BRIEF DESCRIPTION OF THE DRAWINGS

FIG. 3 is a side view of the trainer of FIG. 1.

FIG. 4 is a detail view taken along circle 4 of FIG. 1 of a rotatable swivel joint that can be included in an embodiment constructed in accordance with further aspects of the invention.

FIG. 5 is a detail taken along lines 5-5 of FIG. 1 of a pivot mechanism included in the trainer of FIG. 1.

DETAILED DESCRIPTION OF THE PREFERRED EMBODIMENT

Figure 1:
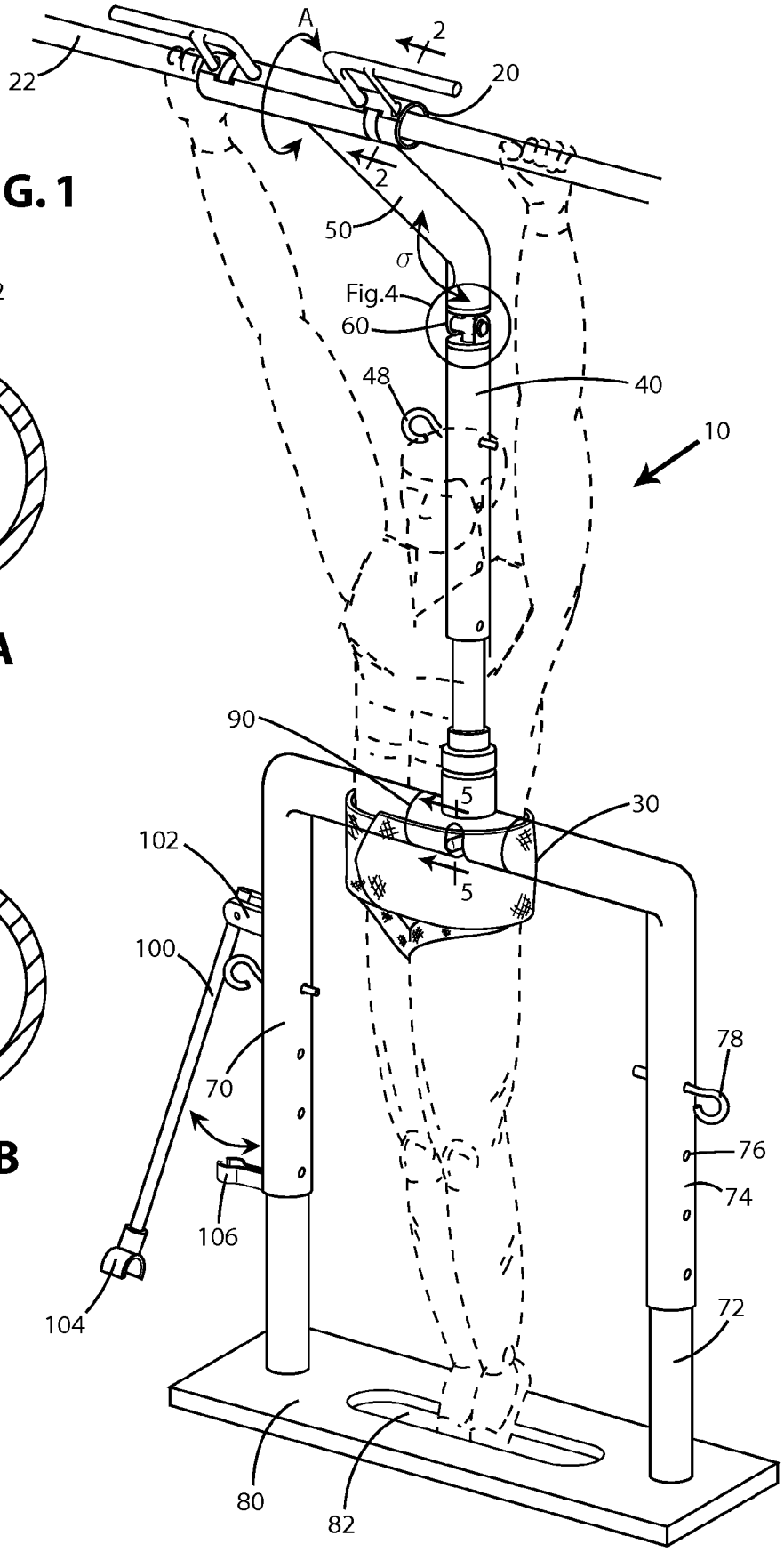
FIG. 1 is a perspective view of a trainer in accordance with an embodiment of the invention showing a gymnast in the hanging position.

Referring now to FIGS. 1 and 3, a giant trainer 10 is illustrated in accordance with an embodiment of the invention and has an engagement 20 rotationally coupled to a high bar 22, the high bar itself forming no part of the present invention. The engagement permits rotation in the directions of arrow A and supports a safety harness 30 which is preferably sizable to fit the pelvis and shoulders of a range of gymnast users.

The safety harness 30 can include one or more leg and shoulder straps 32, 34 which accommodate the legs of a gymnast user. The safety harness 30 is vertically positionable relative to the engagement 26 and the high bar 22 by adjustable upper member 40. In particular, the upper member can comprise telescoping tubes 42, 44 each having respective apertures 46 that can be aligned and secured in position using a T-pin 48, As is known in the art of exercise equipment, the T-pin 48 can include a spring based protrusion that yieldably locks the T-pin in a chosen position. The upper member 40 is adjustable so as to accommodate users of varying arm lengths.

In use, a gymnast grips the high bar and has the safety harness 30 positioned at arms length from the high bar in a hanging position, as shown in FIG. 1. The T-pin 48 is positioned in the holes in tuber 42, 44 to achieve this orientation of the upper member 40.

A gymnast starts from the hanging position below the bar in the giant trainer device 10. With a series of swings, a gymnast will safely develop the strength and technique required to achieve an inverted position above the bar.

The upper member is offset from the engagement 20 by cantilever 50. Cantilever 50 permits the user to hang below the high bar with the safety harness 30 generally positioned below the high bar when in the hanging position.

Optionally, the cantilever 50 is secured to the upper member 40 by a swivel joint 60 (see FIG. 4). The joint 60 permits at least rotation of the upper member 40 in the direction of arrow B. The joint 60 enables a user to release grip from the high bar 22 and perform a pirouette while being cradled by the safety harness 30 and supported from the high bar 22, so as to not fall, by the engagement 20. Alternatively, the swivel joint 60 might be disposed between the engagement 20 and an upper end of the cantilever 50. This arrangement would permit rotation of the upper member 40 in the direction of arrow B, and is presently believed to be an ideal location for the joint 60.

Part of the motion required to achieve a giant from a hanging position is a series of "taps" combined with coordinated small arch and hollow positions which, when properly timed and repeated, advance the user from the hanging position to the start position, in which the gymnast user is upside down, with arms stretched downward and legs stretched upward. Thereafter, the gymnast practices giants, with the trainer 10 attached, and completes the giant maneuver with all wrist shifting motions being performed. Notably, the giant is performed in the trainer without a conventional cast or push away movement.

In order to train leg position and movement in coordination with other movements, the trainer includes lower member 70, illustrated as a U-shaped element. The cover member 70 is preferably adjustable, and can comprise telescoping tubes 72, 74 which secure relative to one another by cinching respective alignment holes 76 with a T-bar 78. The lower member is vertically adjustable so as to accommodate gymnasts of different leg length. A suitable setting for the lower member is one in which telescoping tubes 72, 74 are cinched such that the user's pelvis is in the safety harness 30 and the users legs are fully extended with pointed toes and extending through a grasp hole 82 of a follower board 80.

The follower board 80 provides a surface for the gymnast to stand on while mounting the trainer 10 that is, while securing himself or herself to the safety harness 30 and grasping the high bar 22. The follower board has grasp hole 82, which optionally is padded for comfort, which the gymnast uses to swing the bottom member 80 forward and back during tap and swing and giant movements.

The bottom member and follower board 70, 80 move as an assembly relative to the upper member 4 about a pivot 90, shown in the detail view of FIG. 5. As shown in FIG. 5, the pivot 90 rotationally joins the upper member 40 to the lower member 70 via a housing 92 which is rigidly secured to the upper member via adhesive 94. The housing includes a hollow portion within which lower member 70 can rotate. In one embodiment, the pivot comprises a milled T-joint section of PVC tubing. Rotation of the lower member is preferably limited by a slot 96 and pin 98 arrangement. For example, the slot and pin can limit the lower member to a constrained range of motion of about 100°, say, 30° backward (to generally align with the elongation of cantilever 50) and 70° forward. Such limits prevent the small arch position from becoming too big and the hollow position from becoming too small. In use, the gymnast taps and performs the small arch and hollow positions while moving the lower member 70 due to engagement of his or her pointed toes with the grasp 82. It should be understood that the grasp can take other forms such as a stirrup, if desired, but a proper position includes pointed toes and so the illustrated arrangement is preferred.

Figure 2A:
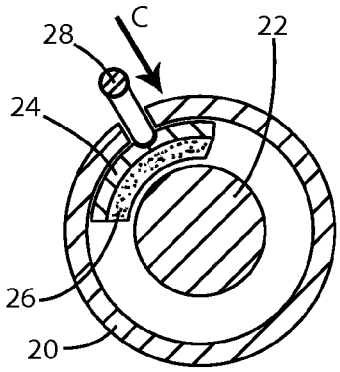
FIGS. 2A and 2B is a cross-sectional view taken along lines 2-2 of FIG. 1 to illustrate a resistance mechanism that optionally can be included in an embodiment constructed in accordance with further aspects of the invention.
Figure 2B:
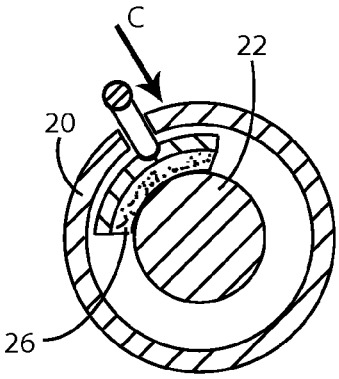

Referring now to FIGS. 1 and 2A and 2B, the engagement 20 preferably comprises a split-bearing construction that can be seated upon the high bar 22 rather than requiring the high bar to be removed from a support to have the engagement slid onto the high bar. Use of a split-bearing connection permits rapid mount and dismount of the trainer 10.

Optionally, the engagement 20 includes a resistance element 24 which is moveable in the direction of arrow C so as to apply a brake material 26 against the high bar 22, such as by manipulating a handle 28. The resistance element increases the force needed to rotate the engagement 20 around the high bar 22 in the direction of arrow A. As a result, the resistance element 24 can assist in training the gymnast by increasing the work necessary to achieve a giant maneuver during training while still requiring wrist shifting motions to complete the maneuver. Optionally, the amount of resistance or drag can be adjustable from none to a range of drag settings.

To provide for a safe dismount from and mount onto the trainer 10, the lower member 70 can be temporarily engaged to a high bar support via a hinged support 100 (see FIG. 1). The support can be connected to the lower member 70 by a hinge 102 and have an opposing end with a grip 104 suitable for engaging or abutting the high bar support. A clip 106 enables the support 100 to be stowed.

Although preferred embodiments of the invention have been disclosed for illustrative purposes, those skilled in the art will appreciate that many additions, modifications and substitutions are possible, without departing from the scope and spirit of the invention as defined by the accompanying claims.

What is claimed:

1. A trainer for giant maneuvers on a high bar comprising:

a high bar positioned at a height above the user;

an engagement rotatably coupled to the high bar wherein the engagement rotates completely around the high bar;

a cantilever perpendicular to a longitudinal axis of the high bar and affixed to the engagement;

an upper support member joined at an obtuse angle to the cantilever in a direction of rotation of the cantilever as the engagement rotates around the high bar;

a lower support member pivotally coupled to the upper support member;

a foot grasp joined to the lower support member at a location remote from the pivotal coupling to the upper support member;

a safety harness coupled to at least one of the upper support member and the lower support member proximate to the pivotal coupling; and wherein the engagement comprises a housing having a split-bearing and a hinge operable to receive the high bar in an open position and support a gymnast on the trainer in a closed position.

2. A trainer for giant maneuvers on a high bar comprising:

a high bar positioned at a height above the user;

an engagement rotatably coupled to the high bar;

a cantilever affixed to the engagement;

an upper support member joined at an obtuse angle to the cantilever;

a lower support member pivotally coupled to the upper support member;

a foot grasp joined to the lower support member at a location remote from the pivotal coupling to the upper support member;

a safety harness coupled to at least one of the upper support member and the lower support member proximate to the pivotal coupling;

wherein the pivotal coupling of the lower support member to the upper support member imparts a constrained range of pivotal motion of the lower support member; and wherein the pivotal coupling further comprises a housing affixed to one of the upper and lower support members and a cavity sized to permit pivotal movement of the other of the upper and lower support members, the housing further comprising a slot and the pivotally moveable support member having a pin that moves with the slot.

3. The trainer of claim 2, wherein the slot is shaped to permit pivotal movement of about 100°.

4. A trainer for giant maneuvers on a high bar comprising:

a high bar positioned at a height above the user;

an engagement rotatably coupled to the high bar wherein the engagement rotates completely around the high bar;

a cantilever perpendicular to a longitudinal axis of the high bar and affixed to the engagement;

an upper support member joined at an obtuse angle to the cantilever in a direction of rotation of the cantilever as the engagement rotates around the high bar;

a lower support member pivotally coupled to the upper support member;

a foot grasp joined to the lower support member at a location remote from the pivotal coupling to the upper support member;

a safety harness coupled to at least one of the upper support member and the lower support member proximate to the pivotal coupling; and further comprising a hinged support coupled to the lower support member and extendable into engagement with a high bar support.

5. The trainer of claim 4, further comprising a clip positioned to engage the hinged support while in a retracted position.

6. A trainer for giant maneuvers on a high bar comprising:

a high bar positioned at a height above the user;

an engagement rotatably coupled to the high bar wherein the engagement rotates completely around the high bar;

a cantilever perpendicular to a longitudinal axis of the high bar and affixed to the engagement;

a support member joined at an obtuse angle to the cantilever in a direction of rotation of the cantilever;

a safety harness coupled to the support member at a location that permits a gymnast to grasp the high bar;

wherein there is only a single engagement coupled to the high bar; and wherein the engagement comprises a housing having a split-bearing and a hinge operable to receive the high bar in an open position and support a gymnast on the trainer in a closed position.

7. A trainer for giant maneuvers on a high bar comprising:

a high bar positioned at a height above the user;

an engagement rotatably coupled to the high bar wherein the engagement rotates completely around the high bar;

a cantilever perpendicular to a longitudinal axis of the high bar and affixed to the engagement;

a support member joined at an obtuse angle to the cantilever in a direction of rotation of the cantilever;

a safety harness coupled to the support member at a location that permits a gymnast to grasp the high bar;

wherein there is only a single engagement coupled to the high bar; and wherein a swivel joint is located at or near where the support member joins the cantilever.

* * * * *